US005368349A

United States Patent [19]

Hebert et al.

[11] Patent Number: 5,368,349

[45] Date of Patent: Nov. 29, 1994

[54] DOOR STOP ASSEMBLY

[76] Inventors: Robert Hebert, 936 Ashton Ct., Vista, Calif. 92083; Paul G. Hebert, 2858 Mary St., Ridgeway, Colo. 81432

[21] Appl. No.: 114,065

[22] Filed: Aug. 31, 1993

[51] Int. Cl.[5] ..... E05C 17/54; E05F 5/02; E05F 5/06

[52] U.S. Cl. ..... 292/343; 16/82; 16/85; 292/DIG. 15

[58] Field of Search ..... 16/82, 85; 292/343, 292/DIG. 15

[56] References Cited

U.S. PATENT DOCUMENTS

| | | | |
|---|---|---|---|
| 804,585 | 11/1905 | Depue . | |
| 943,791 | 12/1909 | Russell | 292/343 |
| 1,064,760 | 6/1913 | Nielsen . | |
| 1,408,316 | 2/1922 | Federius . | |
| 1,676,284 | 7/1928 | Powell . | |
| 1,935,252 | 11/1933 | Spratt et al. . | |
| 1,939,402 | 12/1933 | Moser . | |
| 2,459,070 | 1/1949 | Gard . | |
| 2,568,477 | 9/1951 | Westlund | 16/82 |
| 3,054,632 | 9/1962 | Welch . | |
| 4,230,353 | 10/1980 | Biorgum . | |
| 5,056,836 | 10/1991 | Wells . | |
| 5,199,759 | 4/1993 | Anderson . | |

FOREIGN PATENT DOCUMENTS

| | | | |
|---|---|---|---|
| 584344 | 8/1933 | Germany | 292/343 |
| 278392 | 10/1930 | Italy | 292/343 |

*Primary Examiner*—Carmine Cuda
*Attorney, Agent, or Firm*—Charles C. Logan, II

[57] ABSTRACT

A door stop assembly adapted for introduction into the space between the lower edge of a door and the adjacent floor surface. It has a wedge shaped block whose top surface and bottom surface are oriented toward each other at an acute angle. A flat strip of spring steel has a top leg and a bottom leg that are bent back upon each other in an acute angle. The bottom leg is secured to the bottom surface of the wedge shaped block. The too leg of the spring has a slightly concave curvature that spaces its bottom surface from the top surface of the wedge shaped lock so that any pressure applied to the top surface of the top leg member adjacent its front end will transfer all that pressure directly to the rear edge of the top leg member and force it downwardly against the top surface of the wedge shaped block. There is also structure secured to the bottom surface of the wedge shaped block for preventing it from sliding with respect to a support surface upon which it would be placed adjacent the bottom edge of a door.

8 Claims, 1 Drawing Sheet

DOOR STOP ASSEMBLY

BACKGROUND OF THE INVENTION

The present invention relates generally to a new and novel door security device. More particularly, it relates to a portable security door stop assembly which can be utilized to resist entry of, for example, intruders and other unauthorized individuals.

The idea of a security device for a door to resist entry by unauthorized individuals is well known. Prior art devices have included a variety of door latching mechanisms permanently attached to, or built in the door. Examples of these devices include traditional dead bolt locks, sliding bolt locks and chain locks. Generally, the devices known in the prior art have several disadvantages. Many of these devices have to be integrally installed as part of the door, as is the case of traditional dead bolt locks. Such installations make the removal and transfer of such devices from one door to another very difficult. Other door latching mechanisms are installed onto the door and/or the surrounding frame by means of fasteners, such as screws or nails, as in the case of sliding bolt locks and chain locks. With these devices the strength of the fastener used often limits the amount of force the door latch mechanism can withstand. These devices also require special tools for installation and removal and are time consuming to move from one door to another. Generally, these devices require that the door be closed or substantially closed for the security device to be operative. Thus, if it is desirable to leave the door partially open, for example to provide ventilation, the security device may be inoperative.

Another concern with traditional door latching mechanisms is that they are often operated by a key or other implement. Thus, authorized individuals must have the appropriate key or implement readily available to unlock, or often lock, such devices. Further, the key or implement may come into the possession of unauthorized individuals, who may utilize the key for unauthorized entry through the door. This risk is particularly great in the case of apartments, and motel or hotel rooms, where numerous individuals have had access and possession of the key or implement to the door latching mechanism.

Other prior art devices have utilized various generally wedged-shaped components to secure a door. Examples of these prior art devices can be seen in U.S. Pat. No. 804,585 to Depue, U.S. Pat. No. 943,791 to Russell, U.S. Pat. No. 1,676,284 to Powell, U.S. Pat. No. 1,939,402 to Moser, U.S. Pat. No. 2,459,070 to Gard, and U.S. Pat. No. 4,230,353 to Bjorgum. Such devices have several disadvantages. Since primary contact between the inclined surface of the wedge and the bottom edge of the door is maintained only along a line contact, a minimum amount of surface area contact is available to resist the force of, for example, an unauthorized individual attempting to push the door open. Further if the distance between the floor and the bottom of the door exceeds the height of the wedge, such devices will not engage and secure the door. Also, many existing wedges cannot maintain their position without sliding rearwardly due to an excessive amount of force being applied to the door by someone trying to push it open. Also, wedge-shaped devices are normally somewhat bulky and thus would require additional storage space if utilized, by, for example, a traveler in a motel or hotel.

It is an object of the invention to provide a novel door stop assembly that is light weight, compact and can be easily carried in a traveler's suitcase.

It is also an object of the invention to provide a novel door stop assembly that has a unique structure on its bottom surface for preventing it from sliding with respect to a support surface upon which it would be placed adjacent the bottom edge of a door.

It is another object of the invention to provide a novel door stop assembly that is economical to manufacture and market.

It is an additional object of the invention to provide a novel door stop assembly that has unique structure such that any pressure applied to the top surface of the spring steel member adjacent the front end of the wedge block will transfer all of that pressure directly to the rear edge of the top leg member of the spring and force the rear edge of the spring downwardly against the top surface of the wedge shaped member.

It is a further object of the invention to provide a novel door stop assembly that has an adapter pad that can be installed on smooth, slippery surfaces such as tile or linoleum to function in coordination with the door stop assembly.

SUMMARY OF THE INVENTION

The novel door stop assembly has as its primary components a wedge-shaped member, a flat strip of spring steel and a unique strip of fabric that is secured to the bottom surface of the door stop assembly for preventing it from sliding.

The wedge-shaped member is preferably in the form of a solid block that may be made of wood or plastic material. It would normally weigh less than 5 or 6 ounces. The size of such a door stop assembly that would normally be carried by a traveler to use in securing their entry door from unwanted intruders would be approximately 5 inches long, approximately 2¼ inches high and approximately 2 inches wide.

The spring would preferably be made of twenty gauge spring steel (although other gauges could be used) that is bent into a wedge-shape that forms a top leg member and a bottom leg member that are oriented toward each other at an acute angle. The top leg member of the spring would have a nonplanar bottom surface whose entire length or whose entire length with the exception of its rear edge is spaced upwardly from the top surface of the wedge-shaped member. The bottom leg member would be secured preferably by adhesive material to the bottom surface of the wedge shaped member.

The fabric strip would preferably be of a length to extend substantially along the entire bottom surface of the wedge-shaped member and bottom leg member of the spring. The fabric strip would have a strip of canvas backing forming its top surface. The strip of fabric would have numerous lateral rows of short strands of a synthetic fabric such as nylon laid flat in an overlapping manner with the top ends of the strands oriented in the same direction to form a directional material. There are thousands of these short strands whose top ends would function to engage the top surface of a carpet upon which it would be placed. They would be like little fingers gripping into the carpet and functioning to prevent the wedge shaped member from sliding horizontally along its surface. The particular weave of the fabric is known as mohair. The top ends of the short strands would be facing substantially parallel to the longitudinal axis of the wedge-shaped member and also being angularly oriented toward the rear of the wedge-shaped member. The top surface of the fabric strip is attached to the bottom surface of the wedge-shaped member and bottom leg of the spring by adhesive material.

An auxiliary strip of fabric would be used when the surface upon which the door stop assembly is to be placed is a smooth slippery surface such as floor tile or linoleum. This fabric strip is substantially identical to the other fabric strip but it also includes a layer of tacky hot glue adhesive material that retains its tackiness for repeated uses. In between uses it would be applied to a strip of peel away cover material. The tackiness of the hot glue adhesive is such that it is nearly impossible to slide this strip across the tile or linoleum floor. The orientation of the short strands of this strip would be laid on the floor in such a manner that they would be directed into an aggressive gripping orientation against the rearwardly oriented short strands on the strip of fabric secured to the bottom of the door stop assembly.

The door stop assembly would be installed with its front end in touching or close approximation to the bottom edge of a door. Anyone attempting to force the door inwardly would cause the edge of the door to contact the top surface of the spring approximately $\frac{1}{4}$ to $\frac{3}{8}$ of an inch rearwardly of its front end. Since substantially all of its entire length is spaced upwardly from the top surface of the wedge-shaped member, any pressure applied on the top surface of the spring adjacent its front end would be transferred directly to the rear edge of the top leg member and function to force the rear of the wedge downward. This in conjunction with the superior anti-sliding feature of the fabric strip functions to lock the doorstop assembly in a fixed position that will prevent the door from being forced inwardly no matter how great the force being applied to the door by the intruder.

An adapter wedge assembly can also be used in a situation where there its a waterproofing door seal that results in the bottom edge of the door being a greater height than normal. The adapter wedge assembly has a wedge-shaped block having a front and rear wall having different heights. This allows the wedge-shaped block to be capable of two different height adjustments by reversing the orientation of the front and rear ends of the wedge directional material fabric would be secured to both the top and bottom surface of the adapter wedge and they would have the top end of their short strands oriented in opposite directions.

DESCRIPTION OF THE PREFERRED EMBODIMENT

Figure 1:
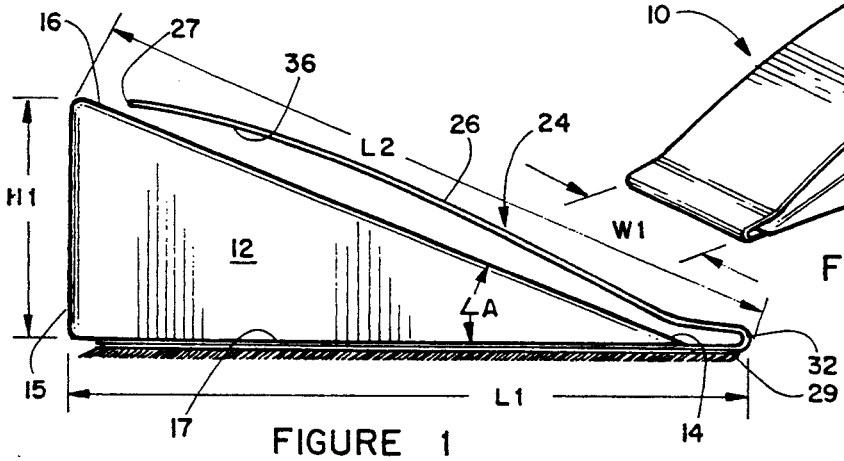
FIG. 1 is a side elevation view of the door stop assembly.
Figure 2:
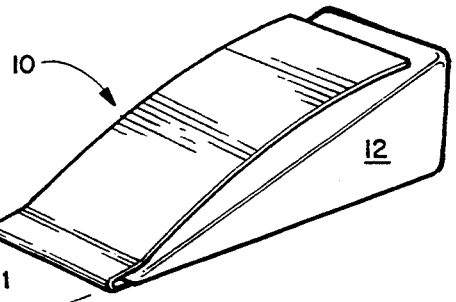
FIG. 2 is a front perspective view of the door stop assembly.
Figure 3:
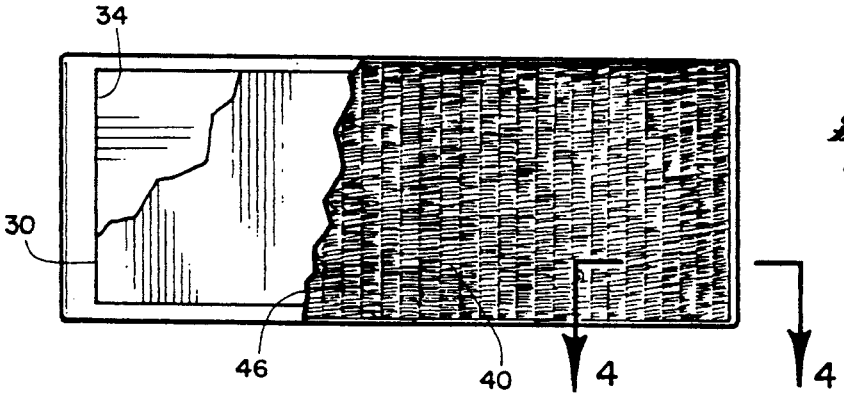
FIG. 3 is a bottom plan view of the wedge-shaped member with portions broken away.
Figure 4:
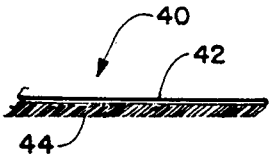
FIG. 4 is an enlarged schematic view taken along lines 4—4 of FIG. 3 showing the structure of the fabric strip.
Figure 5:
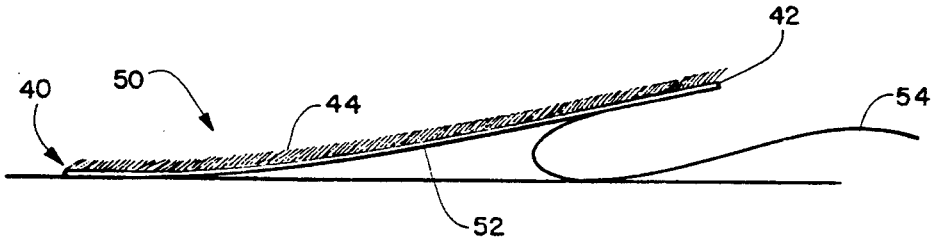
FIG. 5 is a schematic side elevation view of the auxiliary fabric strip.
Figure 7:
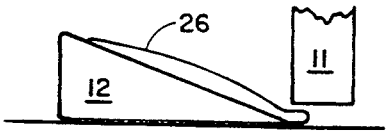
FIG. 7 is a schematic side elevation view showing the manner in which the door stop assembly would engage the bottom surface of a door.

The novel door stop assembly will now be described by referring to FIGS. 1–7 of the drawing. The door stop assembly is generally designated numeral 10 and it restricts the travel of door 11.

Top surface 16 intersects bottom surface 17 at an angle A which is probably in the range between 20–35 degrees. The bottom surface 17 has a length L1. Top surface 16 has a length L2. Rear surface 18 has a height H1 and a width W1.

The flat strip spring 24 has a top leg member 26 having a rear edge 27. It also has a bottom leg member 29 having a rear edge 30. Spring 24 has an integral bend portion 32.

The bottom surface 17 of wedge block 12 has a longitudinally extending recess 34 that receives bottom leg member 29 so that its bottom surface is flush with the bottom surface 17. It would be secured in position by an adhesive material. The front end of spring 24 is slightly spaced forwardly of front edge 14 of the wedge block 12. Top leg member 26 has a slightly concave curvature 36 that causes it to be spaced above top surface 16 of the wedge-shaped member 12.

The fabric strip 40 has a top layer in the form of a strip of canvas backing 42. A plurality of lateral rows of short strands 44 are laid flat in an overlapping manner such that movement in a direction against the orientation of the short strands is resisted and restricted. A layer of adhesive secures the top surface of fabric strip 40 to the bottom surface of bottom leg member 29.

The auxiliary fabric strip member 50 is substantially identical to fabric strip 40 except for the fact it has a layer of tacky hot glue 52 adhered to the outer surface of canvas backing 42. It is this tackiness that allows fabric strip 50 to be securely positioned on a slippery surface such as the or linoleum 53. When not being used, a peel away sheet 54 covers the tacky surface.

Figure 6:
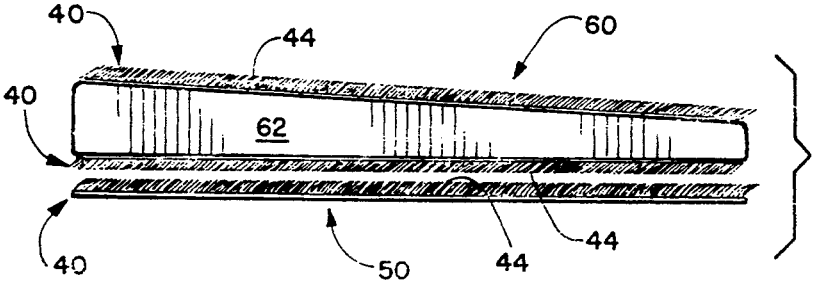
FIG. 6 is a side elevation view of the adaptor wedge assembly.

The adaptor wedge assembly 60 is illustrated in FIG. 6. It has wedge-shaped block 62 having a different height at its front and rear ends so that it can be reversed for different height weather proof seals beneath a door. Fabric strips 40 are glued to the top and bottom surfaces of wedge 62 and their strands 44 are oriented in opposite directions.

FIGS. 1–3, 5 and 6 are drawn to scale.

What is claimed is:

1. A door stop assembly adapted for introduction into the space between the lower edge of a door and the adjacent floor surface comprising:

a wedge-shaped member having a top surface, a front edge, a rear edge, a bottom surface, and a rear surface;

said wedge-shaped member having a predetermined height H1, its bottom surface having a predetermined length L1, and a predetermined width W1, and its top surface having a predetermined length L2;

a spring having a top leg member with a front end and a rear edge, said spring having a bottom leg member with a front end and the front ends of said leg members are oriented toward each other at an acute angle;

the bottom leg member of said spring being secured to the bottom surface of said wedge shaped-member and the top leg member of said spring being positioned above the top surface of said wedge-shaped member in a spaced relationship thereto;

the top leg member of said spring has a bottom surface having a nonplanar surface along its longitudinal axis so any pressure applied to the top surface of said top leg member adjacent its front end will transfer all of that pressure directly to the rear edge of said top leg member and force said rear edge downwardly against the top surface of said wedge-shaped member; and means on the bottom surface of said door stop assembly for preventing it from sliding with respect to a support surface upon which it would be placed adjacent the bottom edge of a door.

2. A door stop assembly as recited in claim 1 wherein said wedge-shaped member is a block made of plastic material.

3. A door stop assembly as recited in claim 1 wherein said wedge-shaped member is a block made of wood.

4. A door stop assembly as recited in claim 1 wherein said spring is made of a flat strip of spring steel.

5. A door stop assembly as recited in claim 1 wherein the bottom surface of said wedge-shaped member has a longitudinally extending recess that receives the bottom leg member of said spring.

6. A door stop assembly as recited in claim i wherein said means on the bottom surface of said doorstop assembly for preventing sliding comprises a strip of fabric formed of laterally extending rows of short strands that are laid flat in an overlapping manner with the top ends of the strands forming a directional material such that movement in a direction against the orientation of the top ends of the short strands is resisted and restricted.

7. A door stop assembly as recited in claim 6 wherein said short strands have bottom ends that are attached to a canvas backing layer that is itself secured to the bottom surface of said door stop by an adhesive material.

8. A door stop assembly as recited in claim 6 further comprising an auxiliary strip of fabric formed of laterally extending rows of short strands that are laid flat in an overlapping manner with the top ends of the strands forming a directional material such that movement in a direction against the orientation of the top ends of the short strands is resisted and restricted, said short strands have bottom ends that are attached to a canvas backing layer and a layer of tacky adhesive is secured to said canvas backing layer.

* * * * *